US005671863A

United States Patent [19]

Uliana

[11] Patent Number: 5,671,863

[45] Date of Patent: Sep. 30, 1997

[54] STATIONARY FLEXIBLE CLIP-ON STRAW

[76] Inventor: Venes J. Uliana, P.O. Box 1415, Palm Springs, Calif. 92263

[21] Appl. No.: 501,982

[22] Filed: Jul. 12, 1995

Related U.S. Application Data

[63] Continuation-in-part of Ser. No. 195,664, May 1, 1994, abandoned.

[51] Int. Cl.[6] ..... A47G 19/22

[52] U.S. Cl. ..... 220/710; 239/33; 229/405; 215/388

[58] Field of Search ..... 239/33; 229/405, 229/103.1; 220/705, 710; 215/388

[56] References Cited

U.S. PATENT DOCUMENTS

| | | | |
|---|---|---|---|
| 103,300 | 5/1870 | Chapin | 239/33 |
| 1,735,144 | 11/1929 | Tanner | 239/33 |
| 2,070,495 | 2/1937 | Strutz et al. | 239/33 |
| 2,460,542 | 2/1949 | Smith | 239/33 |
| 2,469,292 | 5/1949 | Cornwell | 239/33 |
| 3,406,868 | 10/1968 | Rogers | 220/710 |
| 5,046,628 | 9/1991 | Florjancic | 220/710 |

*Primary Examiner*—Andres Kashnikow
*Assistant Examiner*—Lisa Douglas

[57] ABSTRACT

A clip-on straw apparatus permitting persons to drink from a cup, glass, or the like without a need to stabilize the straw by hand.

1 Claim, 1 Drawing Sheet

STATIONARY FLEXIBLE CLIP-ON STRAW

This application is a continuation in part of Ser. No. 08/195664 filed May 1, 1994, now abandoned.

BACKGROUND OF THE INVENTION

Field of the Invention (Technical Field)

The present invention relates to devices for aiding persons to drink liquids from cups or glasses.

SUMMARY OF THE INVENTION (DISCLOSURE OF THE INVENTION)

The present invention is of a straw with a clip manufactured thereon, such as a pen clip, to attach to a cup or glass to stabilize a drinking straw. The preferred use is in a hospital, home, or anywhere, and for people who have palsy or are weak and have shaky hands. The straw will stay in a spot on the glass or cup without the effort of having to hold the straw to get a drink.

A primary object of the present invention is to provide straws for invalids, anyone in a hospital, or children to stabilize a straw in cup, glass or any drinking vessel.

A primary advantage of the present invention is that it gives invalids who cannot drink out of a straw (because it moves and needs securing or someone to hold the straw in one place) the ability to drink liquids.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present invention is of a clip-on straw to provide straws for invalids, anyone in a hospital, or children the ability to stabilize a straw in cup, glass or any drinking vessel or receptable, so that they may drink out of the device in hospital, at home or elsewhere.

Figure 1:
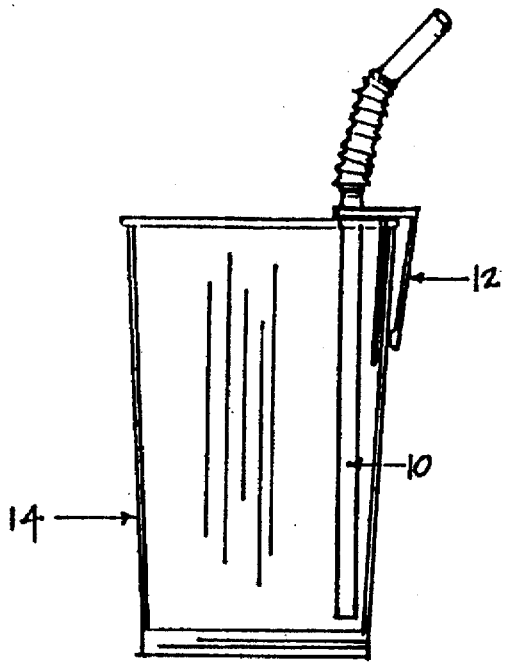
FIG. 1 is an illustration of the preferred clip-on straw.

Referring to FIG. 1, the preferred embodiment comprises a straw 10 with a paper clip 12 manufactured thereon or the like (such as a pen clip) to attach and stabilize a drinking straw in the hospital, home, or anywhere for people who have palsy or are weak or with shaky hands, so straw 10 will stay in a spot with respect to the glass or cup 14 without the effort of having to hold straw 10 to get a drink.

Figure 2:
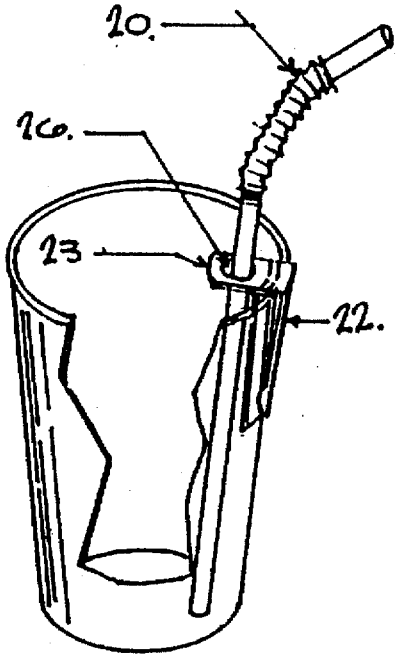
FIG. 2 is an illustration of an alternative clip-on straw having a push-through component.

Referring to FIG. 2, an alternative embodiment employs a plastic straw clip 22 with a hole 26 to push a straw 20 through. The plastic straw clip 22 comprises extension 23 and hole 26 to push straw 20 through. The device is placeable on any glass and is removable.

Figure 3:
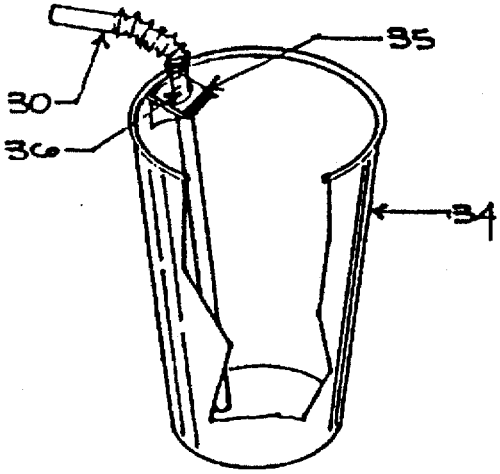
FIG. 3 is an illustration of an alternative clip-on straw for use with a paper cup.

Referring to FIG. 3, an alternative embodiment comprises paper cup 34 which has a piece of cup material 35 attached to the inside of cup 34 that can be folded against the side or swung out. Piece of cup material 35 comprises a hole 36 for straw 30 to be pushed through.

Figure 4:
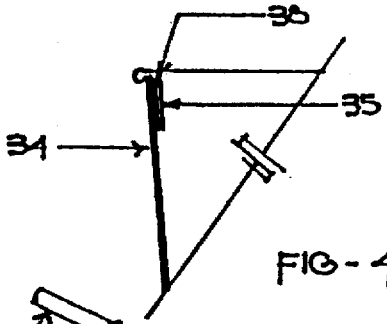
FIG. 4 is an illustration of the FIG. 3 embodiment in the retracted or vertical position.
Figure 5:
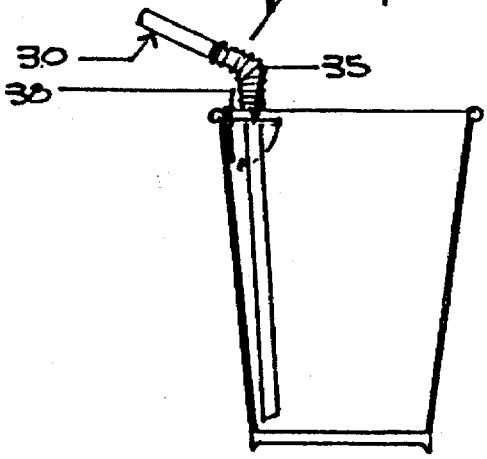
FIG. 5 is an illustration of the FIG. 3 embodiment in the extended, horizontal or operative position.

FIGS. 4 and 5 show the retracted and extended positions of the FIG. 3 embodiment of the invention, respectively. In FIG. 4, cup material or apertured tab 35 is folded to a vertical position about axis 38 to enable nesting of a plurality of cups 34. FIG. 5 shows apertured tab 35 folded horizontally to the operative or horizontal position to mount straw 30 therein.

These clip-on straws are believed to be entirely new and needed to improve the lives of persons.

For example, a primary advantage of the invention is that is gives invalids who cannot drink out of a straw (because it moves and needs to be secured or have someone hold the straw in one place) the ability to drink their own liquids.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. The combination of a drinking receptacle and straw holder comprising an apertured tab attached to the inside of a drinking receptacle proximate the rim of said drinking receptacle;

said apertured tab being foldable about an axis immediately adjacent the inside of said drinking receptacle; and wherein said apertured tab is foldable to a horizontal position for straw mounting therein through said aperture tab, and foldable vertically to enable nesting of a plurality of said drinking receptacles.

* * * * *